US005820535A

United States Patent [19]

Van Der Hoeven et al.

[11] Patent Number: 5,820,535

[45] Date of Patent: Oct. 13, 1998

[54] ABDOMINAL EXERCISING APPARATUS WITH IMPROVED ABDOMINAL ENGAGING DEVICE

[75] Inventors: Martin A. Van Der Hoeven; Jaeson Cayne, both of Carlsbad; Francois Van Der Hoeven, Oceanside, all of Calif.

[73] Assignee: Six-Pack, LLC, Carlsbad, Calif.

[21] Appl. No.: 731,879

[22] Filed: Oct. 22, 1996

Related U.S. Application Data

[63] Continuation-in-part of Ser. No. 597,452, Feb. 2, 1996, abandoned, and Ser. No. 57,810, Aug. 1, 1996, Pat. No. 5,418,830.

[51] Int. Cl.[6] ..... A63B 21/02

[52] U.S. Cl. ..... 482/128; 482/124; 482/139

[58] Field of Search ..... 482/129, 130, 482/139, 133, 137, 124, 128; 601/134, 135; 606/237, 238, 239

[56] References Cited

U.S. PATENT DOCUMENTS

| | | | |
|---|---|---|---|
| 2,106,994 | 2/1938 | Chapman | 482/128 |
| 3,228,392 | 1/1966 | Speyer . | |
| 4,460,171 | 7/1984 | Plyhm | 482/128 |
| 4,517,966 | 5/1985 | Von Othergraven | 482/128 |
| 4,523,583 | 6/1985 | Noble . | |
| 4,759,543 | 7/1988 | Feldman . | |
| 5,033,741 | 7/1991 | Ganzer | 482/128 |
| 5,147,259 | 9/1992 | Hutchins . | |
| 5,158,510 | 10/1992 | Lemire . | |
| 5,160,304 | 11/1992 | Van Der Hoeven . | |
| 5,263,908 | 11/1993 | Chen . | |
| 5,403,269 | 4/1995 | Kennedy | 482/128 |

FOREIGN PATENT DOCUMENTS

| | | |
|---|---|---|
| 12486 | 9/1983 | Australia . |
| 67037 | 4/1991 | Australia . |
| 22152 | 9/1994 | Australia . |
| 65625 | 9/1994 | Australia . |
| 49117 | 12/1994 | Australia . |
| 2710851 | 4/1995 | France . |
| 2724570 | 3/1996 | France . |
| 197284 | 2/1984 | New Zealand . |
| 04879 | 2/1996 | WIPO . |
| 11725 | 4/1996 | WIPO . |

*Primary Examiner*—Lynne A. Reichard
*Attorney, Agent, or Firm*—Christie, Parker & Hale, LLP

[57] ABSTRACT

The present invention improves on prior art abdominal exercisers with horizontally slidable members by providing a large contact area for a subject's abdomen that maximizes the size of the abdominal region that is exercised and increases user comfort compared to prior art devices. In the preferred embodiment, the contact device comprises a substantially convex shape with respect to the vertical dimension of a subject's abdomen, a substantially flat shape with respect to the horizontal dimension of a subject's abdomen, and an outline that is shaped like a disk with a flattened top and bottom, thereby engaging a larger abdominal area than prior art devices. A vertical channel and two horizontal channels divide the device into six sections that make separate contact with a subject's abdomen. In a preferred embodiment, the individual sections have padded surfaces to increase user comfort.

16 Claims, 6 Drawing Sheets

ABDOMINAL EXERCISING APPARATUS WITH IMPROVED ABDOMINAL ENGAGING DEVICE

This is a continuation-in-part of Ser. No. 08/597,452, filed Feb. 2, 1996, entitled "ABDOMINAL EXERCISING APPARATUS WITH IMPROVED ABDOMINAL ENGAGING DEVICE now abandoned, and a continuation-in-part SER. No. 29/057,810, filed Aug. 1, 1996 entitled ABDOMINAL EXERCISING APPARATUS" now U.S. Pat. No. 5,418,830.

FIELD OF THE INVENTION

This invention relates to the increasingly popular field of body development and exercise activity for the purpose to increase tone, size, and definition of musculature. More specifically it relates to isometric exercise methods and devices for developing abdominal and gluteus muscles.

DESCRIPTION OF RELATED ART

It is well-known that the abdominal and gluteus muscles are difficult to isolate and strengthen. Many hours and years of exercise is generally necessary to produce significant effect on the abdominal musculature. An extremely effective prior art device for strengthening of the abdominal musculature without placing unnecessary stress upon the low back is disclosed in U.S. Pat. No. 5,160,304, issued to the inventor of the present patent, and illustrated in FIG. 1. The device illustrated in FIG. 1 is known as the "ABFLEX" device and has enjoyed wide spread commercial success. The device 1 provides for an isometric contraction process of the abdominal musculature which necessarily precludes excessive lumbar movement. The subject pulls with both hands on a pair of handles and simultaneously contracts the abdominal musculature, thereby moving the abdomen against a tensioned member.

More particularly, the device 1 comprises a generally triangular body forming a yoke 2. A pair of handles 3, 4 are positioned on opposite lateral ends of the yoke 2 and are aligned on the same transversal line X—X. An elongated member 5 is slidingly engaged into a channel passing through the center of the yoke in a direction perpendicular to the transversal line X—X. At the inner end of the member, a head 7 is shaped to provide a convenient bearing surface in contact with the user's body. The opposite end of the member engages the median portion of an elastic cord (not shown) whose extremities are attached to a pair of anchoring posts (not shown) projecting from the undersurface of the yoke 2 on opposite sides of the channel 6 and member 5. As the member 5 progresses into the channel 6, it stretches the elastic cord which resiliently opposes the penetration of the member 5 into the channel 6. The member 5 includes a head 7, which is substantially convex with respect to the vertical dimension of the user and substantially flat with respect to the horizontal dimension of the user, for engaging the user's abdomen.

Although the ABFLEX device 1 illustrated in FIG. 1 is a very effective device, its interface with the user is not optimal. Specifically, the head 7 of the resilient member is relatively narrow and short, which focuses the transverse force on a smaller sized portion of the abdomen than is desirable. A related drawback is illustrated by U.S. Pat. No. 3,228,392, issued Jan. 11, 1966 to Speyer, which shows an abdominal exerciser with a tensioned member with a head that is in the form of a plate, the plate being concave with respect to a subject's abdomen. In the horizontal direction, the concave plate illustrated in Speyer tends to concentrate the transverse force at the middle of the plate. Further, the plate tends not to engage the abdominal areas that are horizontally displaced from the center of the plate, decreasing the extent of the abdominal region that is exercised and detracting from user comfort. It is therefore desirable to provide an improved user contact area for abdominal devices similar to the type illustrated in FIG. 1 and the Speyer patent.

SUMMARY OF THE INVENTION

The present invention improves on prior art abdominal exercisers with horizontally slidable members by providing a large contact area for a subject's abdomen that maximizes the size of the abdominal region that is exercised and increases user comfort compared to prior art devices. In a first embodiment, the contact device comprises a substantially convex shape with respect to the vertical dimension of a subject's abdomen, a substantially flat shape with respect to the horizontal dimension of a subject's abdomen, and an outline that is shaped like a disk with a flattened top and bottom, thereby engaging a larger abdominal area than prior art devices. A vertical channel and two horizontal channels divide the device into six sections that make separate contact with a subject's abdomen. In a preferred embodiment, the individual sections have foam rubber surfaces to increase user comfort. In a second embodiment, the vertical and horizontal channels are indented further to define lobes that are designed to make contact with a user's abdomen. Each lobe has a more convex contact surface which may be padded or covered with a soft material to increase user comfort. The overall contour of the vertical dimension of the contact side of the device is less convex.

DETAILED DESCRIPTION OF THE INVENTION

Figure 1:
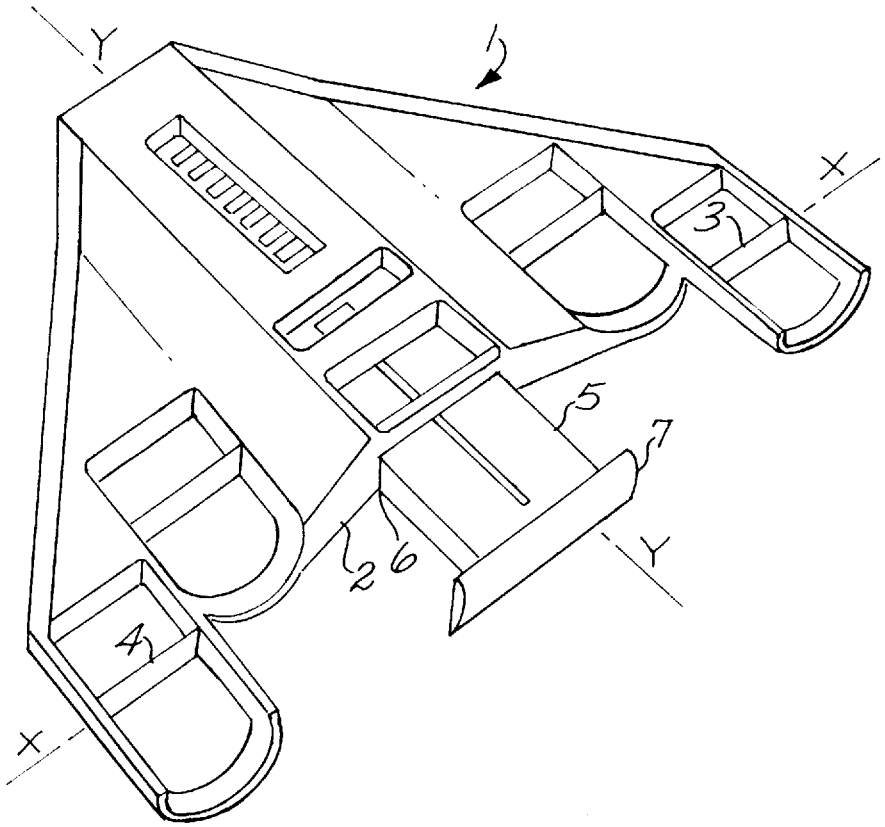
Fig. 1 PRIOR ART
FIG. 1 (prior art) illustrates an exemplary prior art device for exercising abdominal and gluteus muscles.
Figure 2:
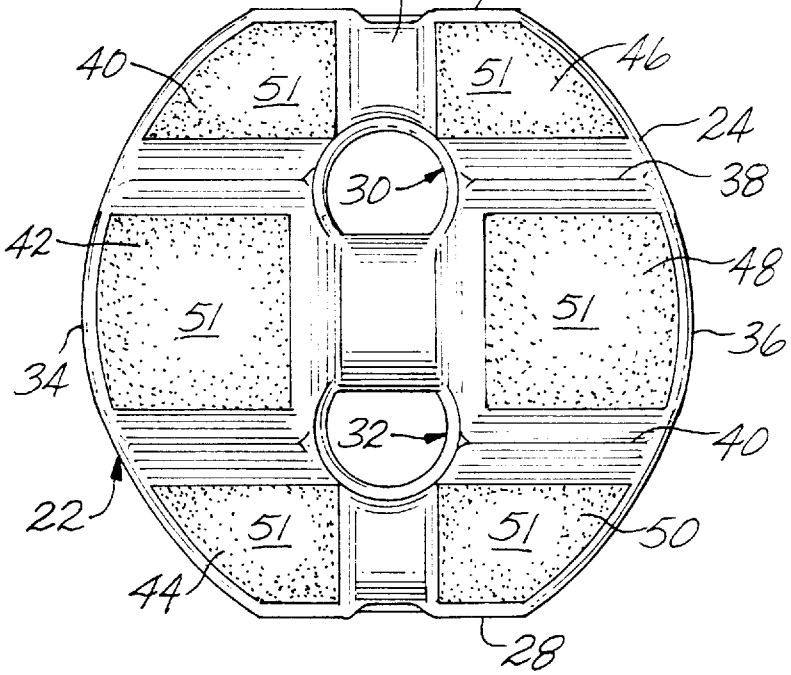
FIG. 2 is a front view of an improved abdominal engaging device in accordance with a first embodiment of the present invention for providing contact with a subject's abdomen.

FIG. 2 is a front view of an improved user contact device 20 that replaces the head 7 of FIG. 1. Although the exerciser illustrated in FIG. 1 is the preferred device for use in conjunction with the improved contact device of the present invention, it will be appreciated that the present invention may be employed with any device that provides force against an abdomen. As shown in FIG. 2, the outline of the improved contact device 20 comprises two arcs 22 and 24 and two substantially horizontal sections 26 and 28, which, from a frontal perspective, forms an outline akin to a type of disk with flattened top and bottom portions. The improved contact device 20 also includes a vertical channel 28 and a plurality of bores 30 and 32 that separate the contact device into left and right halves 34 and 36. The left half 34 and the right half 36 comprise two horizontal channels 38 and 40. The aforementioned partitioning of the contact device 20 results in six distinct contact surfaces 40, 42, 44, 46, 48 and 50 that are substantially flat with respect to the horizontal dimension. In the preferred embodiment, for user comfort, the six contact surfaces 40, 42, 44, 46, 48 and 50 are covered respectively with appropriately contoured foam rubber sections 51.

Figure 3:
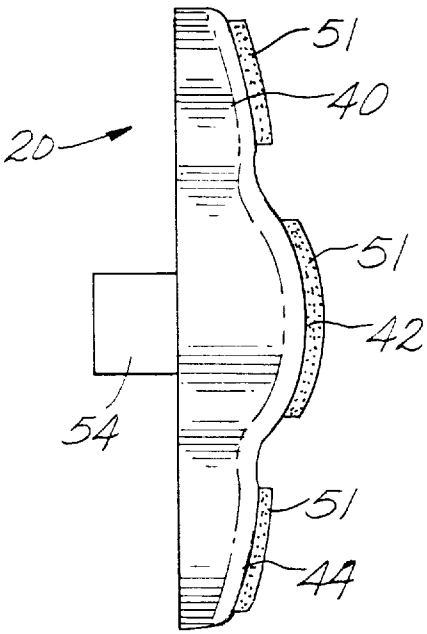
FIG. 3 is a side view of the improved abdominal contact device illustrated in FIG. 2.

FIG. 3 is a side view of the improved contact device 20. As shown, the outline of the improved contact device 20 is convex in the vertical dimension with respect to the human abdomen. To further conform the improved contact device to the human abdomen, each of the sections 40, 42, 44, 46, 48 and 50 themselves are convex with respect to the abdomen, with the section 42 (and opposite section 48) more convex than the sections 40 and 44 (and opposite sections 46 and 50). A stub 54 extends from the rear of the contact device 20 for attachment to an abdominal exercising apparatus (e.g., to member 5 in the apparatus of FIG. 1).

In the preferred embodiment, the improved contact device is formed of hard plastic having a shell like structure to improve rigidity.

Referring now to FIGS. 4 to 7, a second embodiment of an abdominal contact device 100 of the present invention is illustrated. The primary differences between this embodiment and the preceding embodiment illustrated in FIGS. 2 and 3 are that the discrete sections that are designed to come into contact with the user's abdomen are defined with a more convex contact surface and the overall contour of the contact face of the device 100 in its vertical dimension is less convex.

Figure 5:
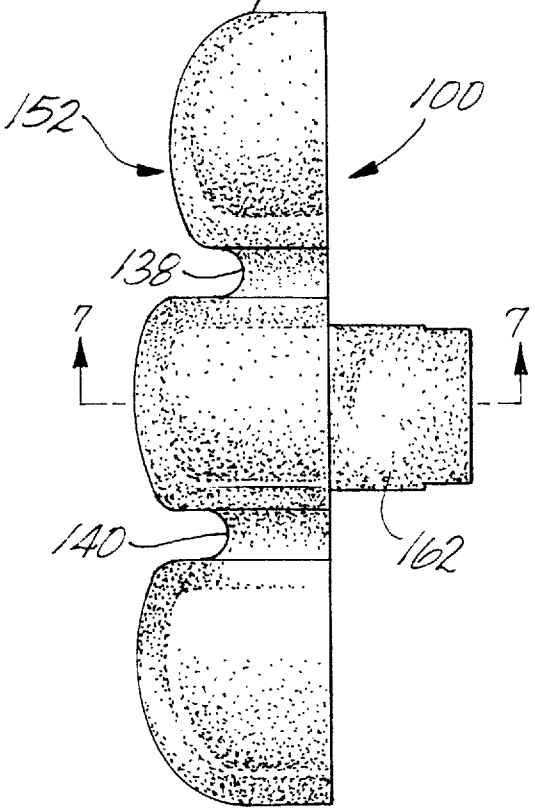
FIG. 5 is a side view of the device in FIG. 4.
Figure 4:
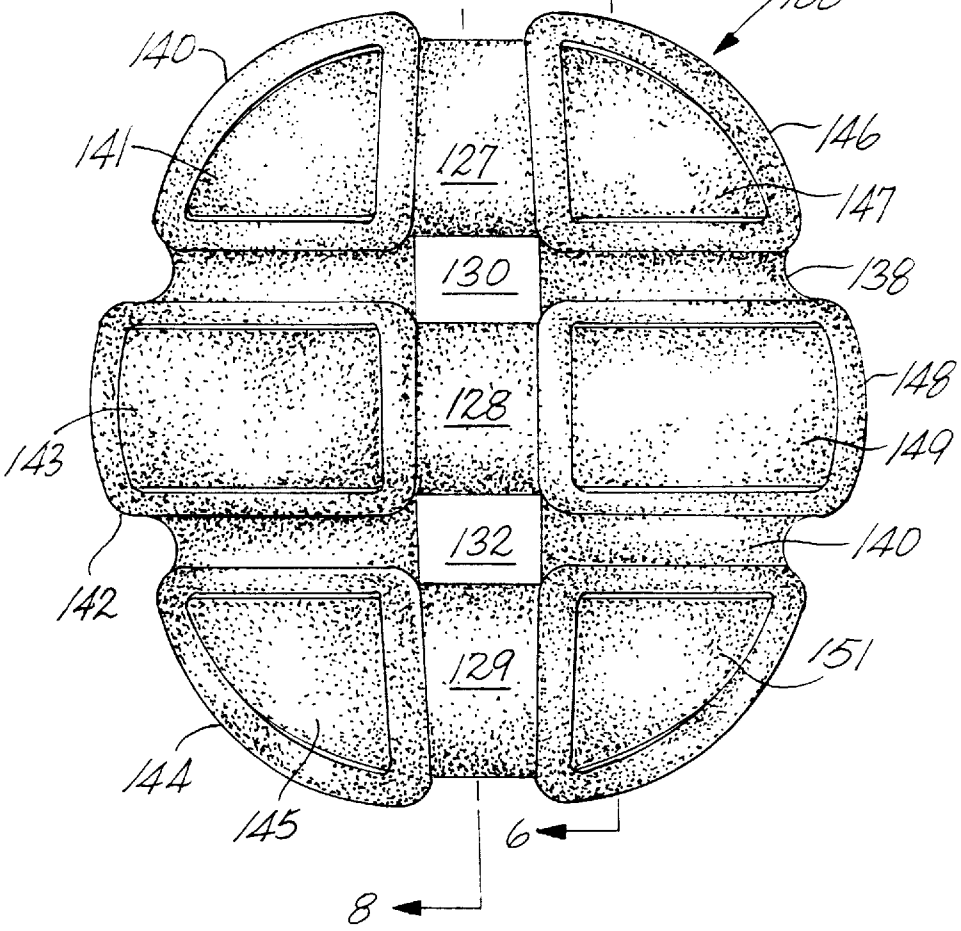
FIG. 4 is a front view of an improved abdominal engaging device in accordance with another embodiment of the present invention for providing contact.
Figure 7:
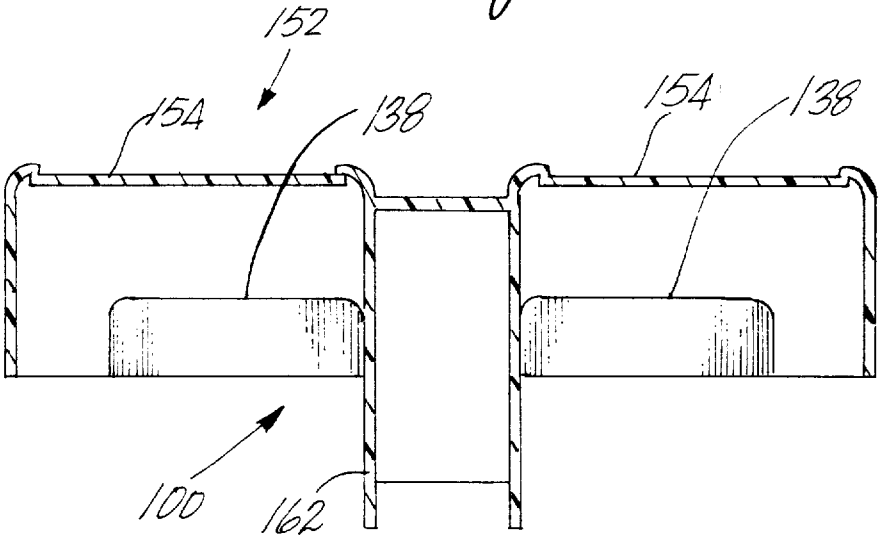
FIG. 7 is a sectional view taken along line 7—7 in FIG. 5.

As seen in FIG. 5, channels 138 and 140 and spacers 127, 128 and 129 in the device 100 define six lobes 140, 142, 144, 146, 148 and 150 each having an upper contact surface (141, 143, 145, 147, 149 and 151). The channels 138 and 140 are more deeply indented from the contact surfaces of the lobes 140, 142, 144, 146, 148 and 150, as compared to the previous embodiment. The lobes 140, 144, 146 and 150 each has a more convex contact surface (141, 145, 147 and 151), as compared to the previous embodiment. The overall contour of the contact face 152 of the device 100 in the vertical dimension is less convex than the previous embodiment. Like the previous embodiment, the overall contour of the contact surface of the device 100 is substantially flat in the horizontal dimension (see FIG. 7).

Figure 6:
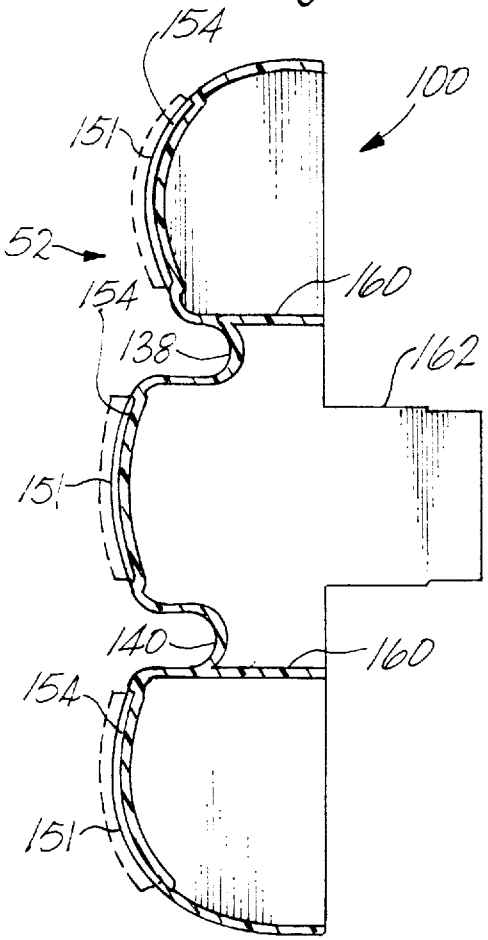
FIG. 6 is a sectional view taken along line 6—6 in FIG. 4.

Referring to FIG. 6, foam rubber pads 151 may be provided on the contact surfaces 140, 142, 144, 146, 148 and 150 of the lobes as shown in phantom. Depressions 154 are provided on these contact surfaces to accommodate the foam rubber pads 151. This improves user comfort as the device 100 is pushed against the user's abdomen.

Figure 8:
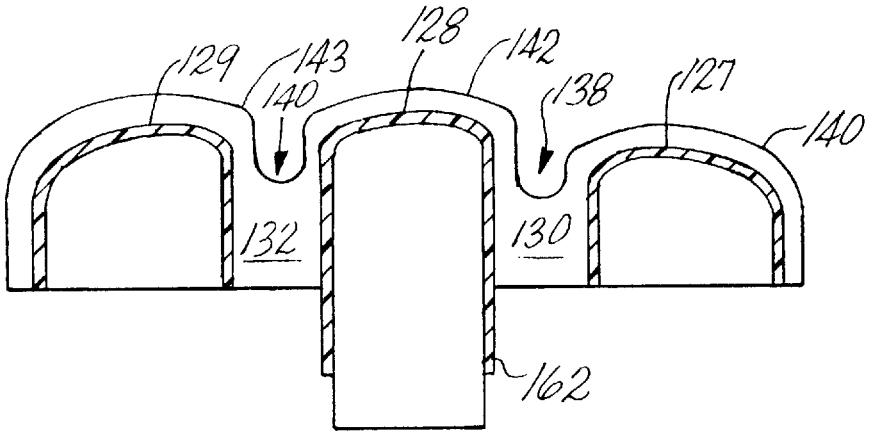
FIG. 8 is a sectional view taken along line 8—8 in FIG. 4.

To minimize the weight of the device 100 without compromising structural rigidity, it has, like the previous embodiment, a shell like structure. This can be seen from FIGS. 6 and 7. The "skin" of the device 100 is relative thin (on the order of 2 to 3 mm). Ribs or webs 160 are provided behind the contact face of the device 100 to increase the structural rigidity of the shell structure. Further, the channels 138 and 140 form a corrugated structure which also improves rigidity of the shell structure. The three spacers 127, 128 and 129 are also convex with a hollow back (see FIG. 8).

Figure 9:
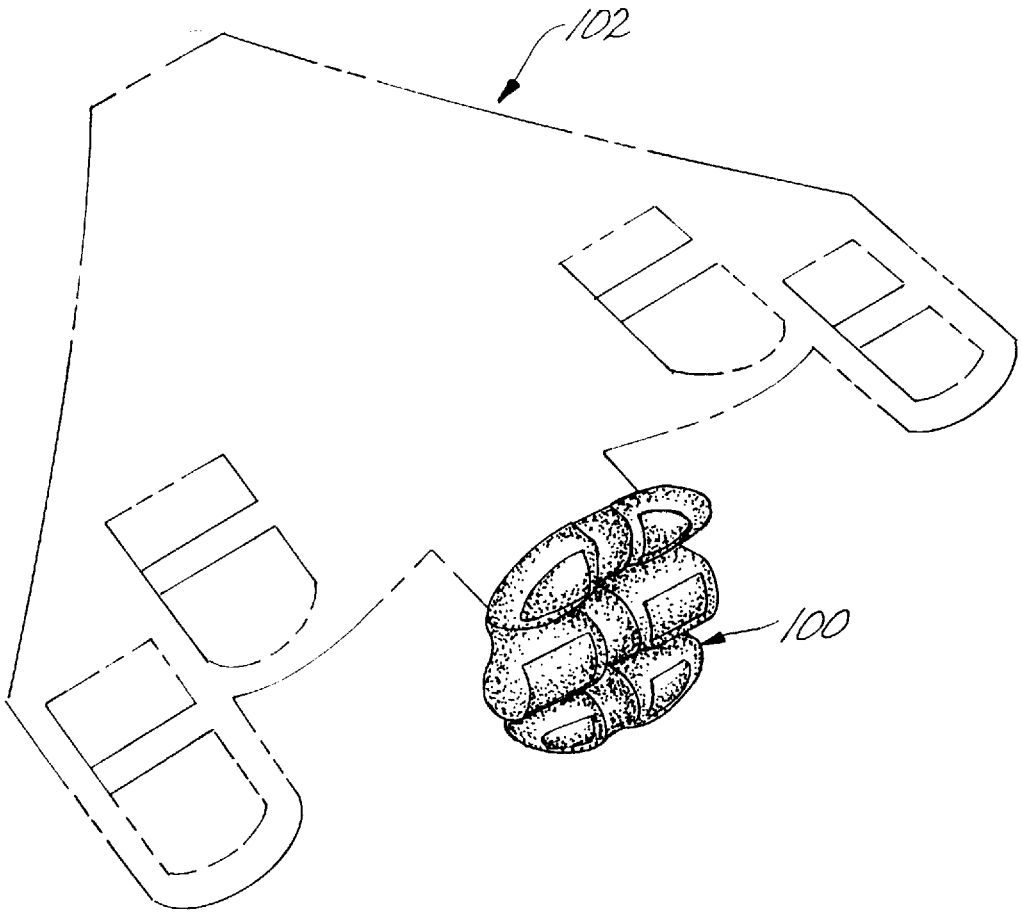
FIG. 9 is a perspective view illustrating in phantom an abdominal exercising apparatus to which the abdominal contact device may be mounted.

A stub 162 extends from the back of the contact device 100 for coupling to an abdominal exerciser. FIG. 9 illustrates the coupling of the device 100 to an abdominal exerciser 102, which is shown in phantom. An actual abdominal exerciser may be the apparatus 1 shown in FIG. 1, the a combination abdominal exercising apparatus disclosed in copending U.S. patent application Ser. No. 08/607,616, filed on Feb. 22, 1996.

For the illustrated embodiment, the overall dimensions of the device 100 is about 15 cm in the largest vertical dimension and 15 cm in the largest horizontal dimension. The dimensions of the lobes are on the order of 5 cm by 3 cm for the largest lobes, and on the order of 3 cm by 3 cm for the smallest lobes.

It has been found that the device 100 provides a more effective contact with the user's abdomen for purposes of performing exercises using an abdominal exerciser attached thereto. The lobes with a more convex surface serve as pressure points which messages the abdomen as the contact devices 100 presses against the abdomen during an exercise routine using the abdominal exerciser. The rounded corners of the lobes 140, 144, 146, and 150 at the corners of the device 100 provide more comfortable contact of the device 100 with the user's abdomen. To conform more to the anatomy of the user's abdomen, the lobes 140 and 146 are shorter than the lobes 144 and 150 (see FIG. 5). When using an abdominal exerciser of the type shown in FIG. 1, the device 100 may be positioned with respect to the user such that the lobes 140 and 146 are closer to the user's torso. When using a "crunch" type exerciser of the type disclosed in the copending patent application Ser. No. 08/607,616, it may be preferred to have the lobes 144 and 150 positioned closer to the user's torso, as these lobes offer a more rounded corner to accommodate bending of the abdomen as the torso rocks forward in a "crunch" type exercise.

Although the abdominal contact device of this invention for an abdominal exerciser has been described in terms of the illustrated embodiments, it will be appreciated that various modifications and alterations might be made by those skilled in the art without departing from the spirit and scope of the invention. The invention should therefore be measured in terms of the claims which follow.

What is claimed is:

1. An abdominal contact device designed for use with an exercising apparatus, said device comprising:

a body having a front contact side for engaging an abdomen of a user comprising a plurality of separate convex shaped contact surfaces defined by a vertical channel and at least one horizontal channel in the contact side; and means on the body for facilitating coupling of the contact device to the exercising apparatus.

2. The device of claim 1 wherein said contact side is dimensioned to provide an overall shape which is substantially convex with respect to a vertical dimension of the abdomen, and is substantially flat with respect to a horizontal dimension of the abdomen.

3. The device of claim 2 wherein said plurality of contact surfaces are defined by one vertical channel and two horizontal channels in the contact side.

4. The device of claim 3 wherein the vertical and horizontal channels define a pair of middle sections, a pair of top sections, and a pair of bottom sections, wherein each section has one said contact surface.

5. The device of claim 1 wherein each contact surface is padded.

6. The device of claim 1 wherein the body is constructed of a thin shell structure that is reinforced with webs.

7. The device of claim 1 wherein the body is defined by integral lobes at the contact side, each bearing one said contact surface.

8. The device of claim 7 wherein the lobes are of different heights in the vertical dimension of the body.

9. An apparatus for exercising the musculature of a user comprising:

a rigid frame;

a rigid shaft movably mounted on said frame;

resilient means for biasing said shaft away from said frame;

a contact device at a distal portion of said shaft for contact with a user's abdomen said contact device comprising a body having a front contact side comprising a plurality of separate convex shaped contact surfaces defined by a vertical channel and at least one horizontal channel in the contact side.

10. The device of claim 9 wherein said contact side is dimensioned to provide an overall shape which is substantially convex with respect to a vertical dimension of the abdomen, and is substantially flat with respect to a horizontal dimension of the abdomen.

11. The device of claim 10 wherein said plurality of contact surfaces are defined by one vertical channel and two horizontal channels in the contact side.

12. The device of claim 11 wherein the vertical and horizontal channels define a pair of middle sections, a pair of top sections, and a pair of bottom sections, wherein each section has one said contact surface.

13. The device of claim 9 wherein each contact surface is padded.

14. The device of claim 9 wherein the body is constructed of a thin shell structure that is reinforced with webs.

15. The device of claim 9 wherein the body is defined by integral lobes at the contact side, each bearing a said contact surface.

16. The device of claim 15 wherein the lobes are of different heights in the vertical dimension of the body.

* * * * *